US011541293B1

(12) United States Patent
Pinera et al.

(10) Patent No.: US 11,541,293 B1
(45) Date of Patent: Jan. 3, 2023

(54) BATTING TEE

(71) Applicants: Gerardo Montesino Pinera, Hialeah, FL (US); Tamara camejo cruz, Hialeah, FL (US)

(72) Inventors: Gerardo Montesino Pinera, Hialeah, FL (US); Tamara camejo cruz, Hialeah, FL (US)

( * ) Notice: Subject to any disclaimer, the term of this patent is extended or adjusted under 35 U.S.C. 154(b) by 0 days.

(21) Appl. No.: 17/931,121

(22) Filed: Sep. 10, 2022

(51) Int. Cl.
*A63B 71/00* (2006.01)
*A63B 69/00* (2006.01)

(52) U.S. Cl.
CPC ..... *A63B 69/0075* (2013.01); *A63B 69/0002* (2013.01); *A63B 2069/0008* (2013.01); *A63B 2225/093* (2013.01)

(58) Field of Classification Search
CPC ..... A63B 2069/0008; A63B 69/0002
USPC ..... 473/417
See application file for complete search history.

(56) References Cited

U.S. PATENT DOCUMENTS 3,139,282 A * 6/1964 Lande ..... A63B 69/0075 473/417
5,388,823 A * 2/1995 Prieto ..... A63B 69/0075 473/417
5,797,810 A * 8/1998 Sandoval ..... A63B 69/0091 473/423
6,413,175 B1 * 7/2002 Mooney, Jr. ..... A63B 69/0075 473/422
6,458,037 B1 * 10/2002 Dixon, Jr. ..... A63B 69/0002 473/422
7,226,373 B2 * 6/2007 Arenas ..... A63B 69/0091 473/422
D554,716 S * 11/2007 Seeley ..... D21/698
7,354,360 B1 * 4/2008 Eckstein ..... A63B 69/0075 473/422
7,641,573 B2 * 1/2010 Cech ..... A63B 69/0002 473/417
8,113,970 B2 * 2/2012 Mauer ..... A63B 47/002 473/417
8,118,692 B2 * 2/2012 Day ..... A63B 69/0002 473/422
8,137,218 B2 * 3/2012 Le niewicz ..... A63B 69/38 473/430
8,147,357 B1 * 4/2012 Nichols ..... A63B 69/0002 473/453
8,535,178 B2 * 9/2013 Keller ..... A63B 69/0075 473/422
8,574,101 B2 * 11/2013 Wheel ..... A63B 69/20 473/422
8,992,348 B2 * 3/2015 Meier ..... A63B 69/0057 473/422
9,067,113 B2 * 6/2015 Kammer ..... A63B 69/0002 473/417

(Continued)

*Primary Examiner* — Mitra Aryanpour
(74) *Attorney, Agent, or Firm* — Ruben Alcoba, Esq

(57) ABSTRACT

A batting tee that can be used by righthanded and lefthanded hitters to expand their batting zone. The batting tee comprises of two weighted legs that extend from a point of origin, an angle of twenty-five degree is created between the two weighted legs. Each weighted leg is hollow and defines an upper and a lower linear channel that can receive a block that sustains a screw in post. The post has a ball holder. A triangular weighted sheet attaches to an inside side of each weighted leg. Each leg defines a block insertion point at a location that is at a furthest distance from the point of origin, the block insertion points are defined on the upper part and the power part of each leg.

5 Claims, 19 Drawing Sheets

(56) References Cited

U.S. PATENT DOCUMENTS

| | | | | |
|---|---|---|---|---|
| 9,220,965 | B1 * | 12/2015 | Hochberg | A63B 69/0075 473/417 |
| 9,358,440 | B1 * | 6/2016 | Burrell | A63B 69/0002 473/417 |
| 9,452,336 | B2 * | 9/2016 | Nelson | A63B 69/0075 473/417 |
| 9,457,252 | B2 * | 10/2016 | Schwarz | A63B 69/0075 473/417 |
| 9,492,727 | B2 * | 11/2016 | Brossman | A63B 69/0075 473/417 |
| 9,757,636 | B1 * | 9/2017 | Schwarz | A63B 69/0002 473/417 |
| 9,914,034 | B2 * | 3/2018 | Lee | A63B 69/0091 473/417 |
| 10,406,419 | B1 * | 9/2019 | Dickerson | A63B 69/0091 473/417 |
| 10,583,343 | B2 * | 3/2020 | Pippitt | A63B 69/0075 473/417 |
| 10,835,798 | B2 * | 11/2020 | Corniel | A63B 71/023 473/417 |
| 11,161,024 | B1 * | 11/2021 | Hochberg | A63B 69/0002 473/417 |
| 11,185,752 | B2 * | 11/2021 | Ferrari | A63B 71/023 473/417 |
| 11,285,374 | B2 * | 3/2022 | Hunt | A63B 69/0002 473/417 |
| 2009/0305824 | A1 * | 12/2009 | Sanders | A63B 69/0002 473/417 |
| 2010/0016100 | A1 * | 1/2010 | Liu | A63B 69/0073 473/417 |
| 2015/0231470 | A1 * | 8/2015 | Kanner | A63B 69/0075 473/417 |
| 2020/0197776 | A1 * | 6/2020 | Gonzalez | A63B 69/0013 473/417 |

* cited by examiner

BATTING TEE

BACKGROUND

The present invention is directed to a batting tee that is used by righthanded and lefthanded hitters to expand their batting zone.

The batting tee is designed to allow either a righthanded hitter or a lefthanded hitter to hit any ball pitched over home plate.

The batting tee is designed to allow a hitter to adjust his swing in accordance with the location of the ball when it passes over home plate.

The batting tee teaches the hitter where to connect with a ball in relation to home plate and wherein the ball will be driven after the connection.

The batting tee is designed to allow a hitter to develop muscle memory with regards to a swing that passes over a certain area of a home plate.

Muscle memory and hand to eye coordination is what makes a hitter. This invention is made to train the hitter in hand to eye coordination, while also creating the muscle memory required to hit a ball that passes through any area of home plate.

SUMMARY

The present invention is directed to a batting tee that is used by righthanded and lefthanded hitters to expand their batting zone.

The batting tee comprises of two weighted legs that extend from a point of origin, an angle of twenty-five degree is created between the two weighted legs. Each weighted leg is hollow and defines an upper and a lower linear channel that can receive a block that sustains a screw in post. The post defines a ball holder. A triangular weighted sheet attaches to an inside side of each weighted leg. Each leg defines a block insertion point at a location that is at a furthest distance from the point of origin, the block insertion points are defined on the upper part and the lower part of each leg.

Presently, Baseball has considerably increased its competitiveness, so that players have been forced to train more. Pitchers are pitching faster, so batters have been forced to improve their batting skills.

Manny players know that to have a good connection with an inside pitch, the batter must advance the swing forward to hit the ball, thereby hitting the ball with the sweet spot of the bat, see FIGS. 7-8 and FIGS. 12-13. Players also know that when the pitch is an outside pitch, the batter must delay the swing, thereby hitting the ball with the sweet spot of the bat, see FIGS. 9,10,11 and 14, 15, 16.

This invention trains the player to hit the ball at simulated areas wherein an inside or an outside pitch would pass.

This invention has upper and lower channels wherein a tee can be placed to simulate the location of the ball. The reason for the upper and lower channels being that the batting tee can be used by righthanded hitters and lefthanded hitters. It should be added that this batting tee is designed in the form of a triangle that simulates home plate. The batting tee can be used to simulate the forward part of home plate and the rear part of home plate. The batting tee has a width of 8.5 inches at its widest angle. One of the legs of the batting tee is always lined up with the inner part of home plate, an inside pitch, or the outer part of home plate, an outside pitch. As the tee is moved on the leg that is not aligned with either the inside or outside of home plate, the batter is trained to swing at pitches that are neither inside or outside pitches, and the placement of the tee will determine where the batter will connect with the ball and also determine the trajectory of the ball after the connection.

FIG. 1 shows how the batting tee would be used by a righthanded batter to hit balls that would run from the inside corner of the home plate to the center of the home plate, see FIGS. 7, 8 and 9.

FIG. 2 shows how the batting tee would be used by a righthanded batter to hit balls that would run from the center of the home plate to the outside corner of home plate, see FIGS. 10 and 11.

FIG. 3 shows how the batting can be placed over home plate to hit all balls passing over the plate for a righthanded batter.

FIG. 4 shows how the batting tee would be used by a lefthanded batter to hit balls that would run from the inside corner of the home plate to the center of the home plate, see FIGS. 12, 13 and 14.

FIG. 5 shows how the batting tee would be used by a lefthanded batter to hit balls that would run from the center of the home plate to the outside corner of home plate, see FIGS. 15 and 16.

FIG. 6 shows how the batting can be placed over home plate to hit all balls passing over the plate for a lefthanded batter.

An object of the present invention is to provide a batting tee that is easy to manipulate.

Another object of the present invention is to provide a batting tee that is easy to transport.

Yet another object of the present invention is to prove a batting tee that can be used by righthanded and lefthanded hitters to maximize their hitting potential over balls that pass over home plate.

BRIEF DESCRIPTION OF DRAWINGS

These and other features, aspects, and advantages of the present invention will become better understood with regards to the following description, appended claims, and drawings where:

DESCRIPTION

Figure 1:
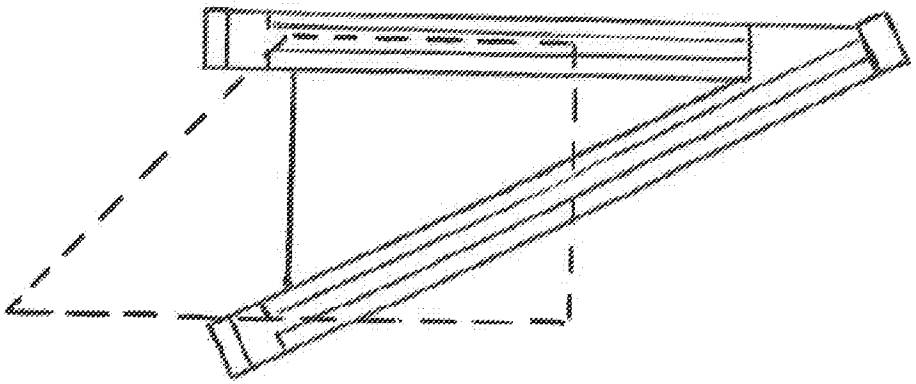
FIG. 1 is a drawing that shows how the present invention would be placed over home plate to a righthanded batter when simulating an inside pitch.
Figure 2:
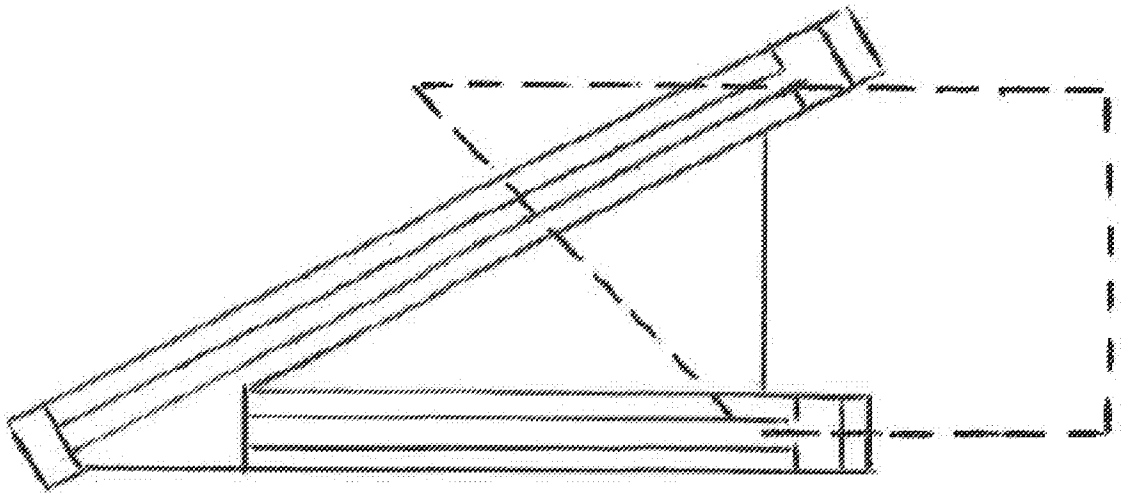
FIG. 2 is a drawing that shows how the present invention would be placed over home plate to a righthanded batter when simulating an outside pitch.
Figure 3:
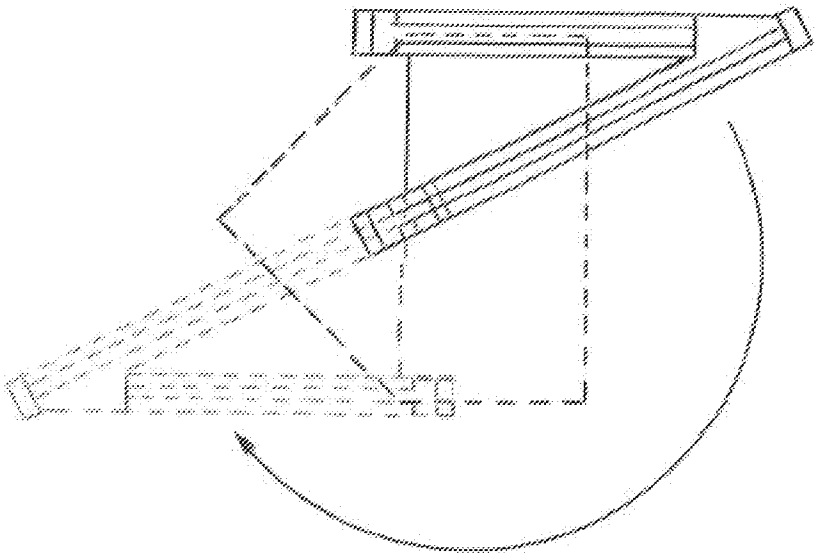
FIG. 3 is a drawing that shows how the present invention would be placed over home plate to righthanded batter to simulate all pitches passing over home plate.
Figure 4:
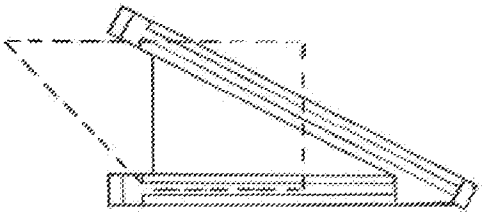
FIG. 4 is a drawing that shows how the present invention would be placed over home plate to a lefthanded batter when simulating an inside pitch.
Figure 5:
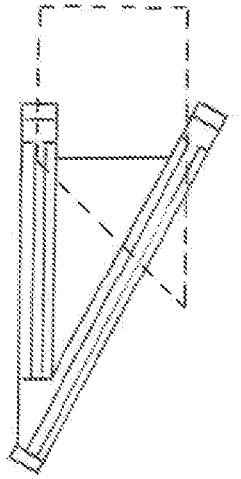
FIG. 5 is a drawing that shows how the present invention would be placed over home plate to a lefthanded batter when simulating an outside pitch.
Figure 6:
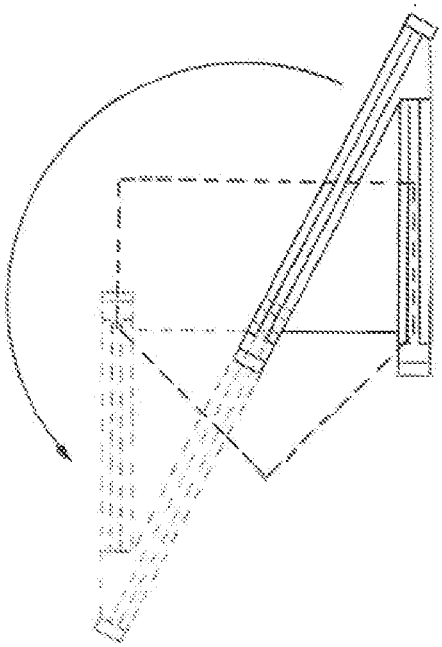
FIG. 6 is a drawing that shows how the present invention would be placed over home plate to lefthanded batter to simulate all pitches passing over home plate.
Figure 7:
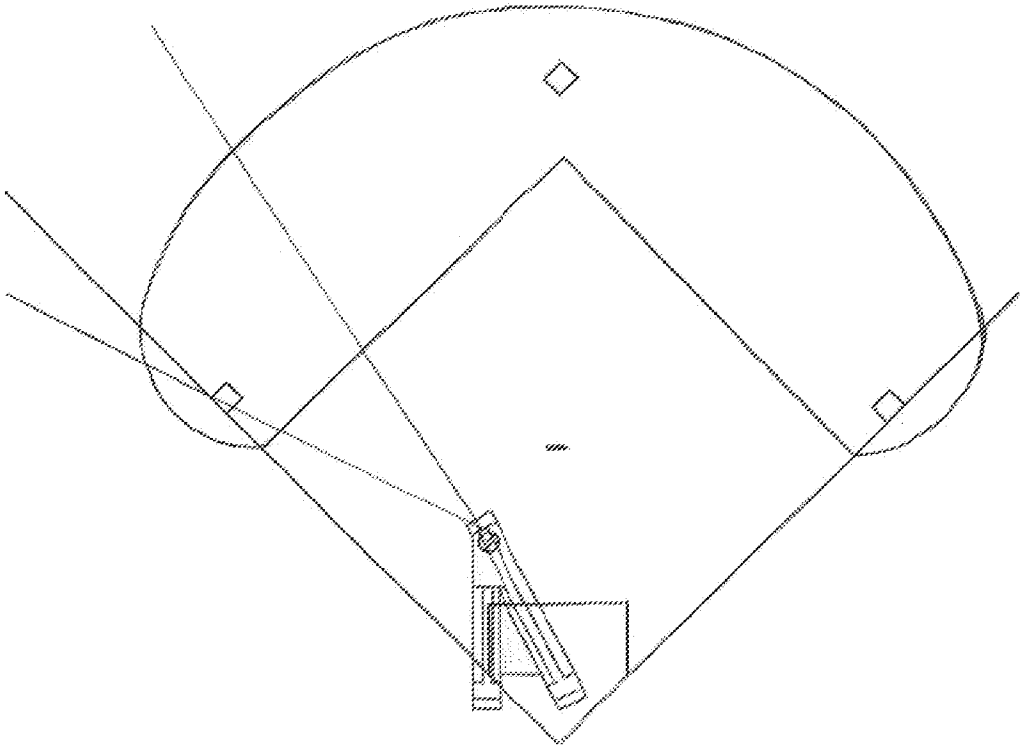
FIG. 7 is a drawing that shows how the present invention would be used to hit an inside pitch by a righthanded batter and the direction in which the ball would travel after being hit.
Figure 8:
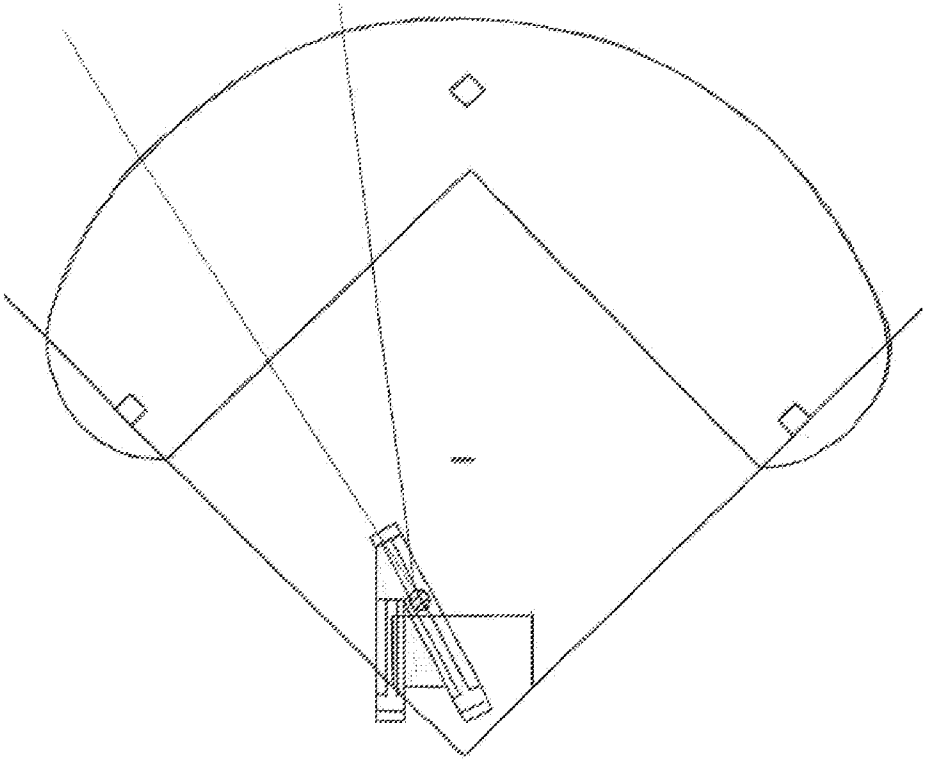
FIG. 8 is a drawing that shows how the present invention would be used to hit another inside pitch by a righthanded batter and the direction in which the ball would travel after being hit.
Figure 9:
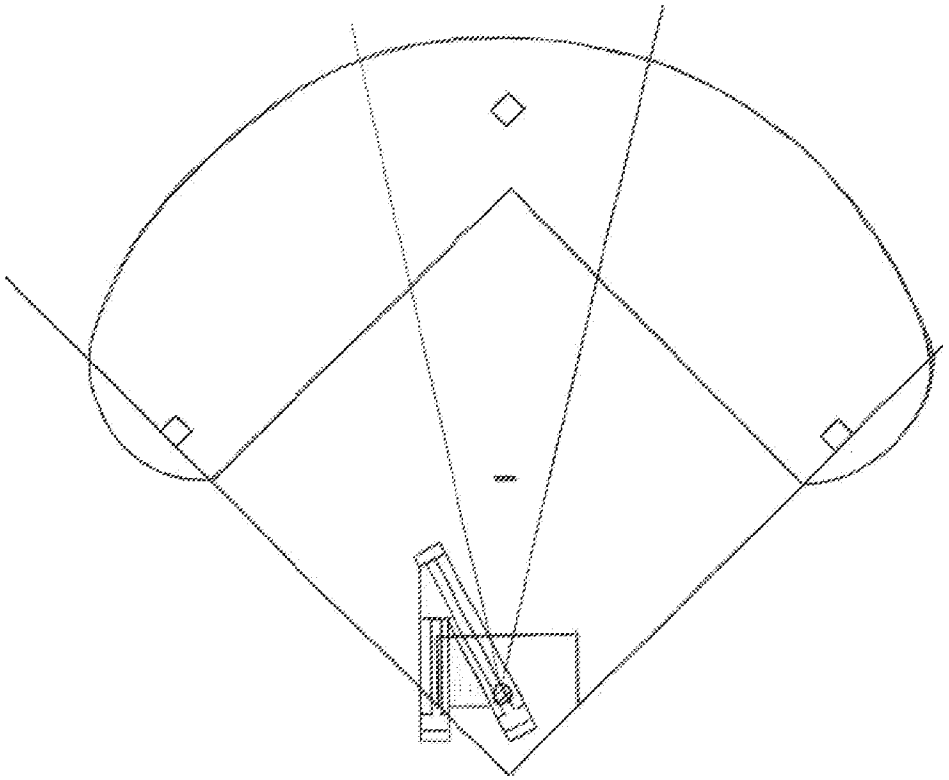
FIG. 9 is a drawing that shows how the present invention would be used to hit a middle pitch by a righthanded batter and the direction in which the ball would travel after being hit.
Figure 10:
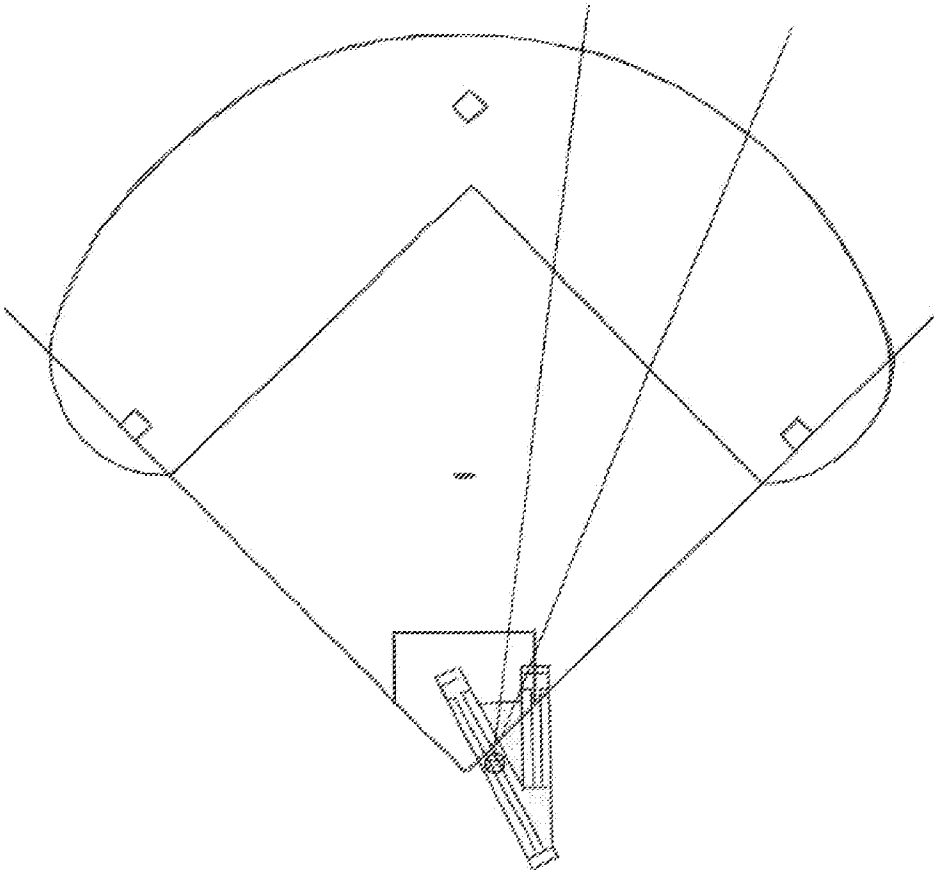
FIG. 10 is a drawing that shows how the present invention would be used to hit a middle to outside pitch by a righthanded batter and the direction in which the ball would travel after being hit.
Figure 11:
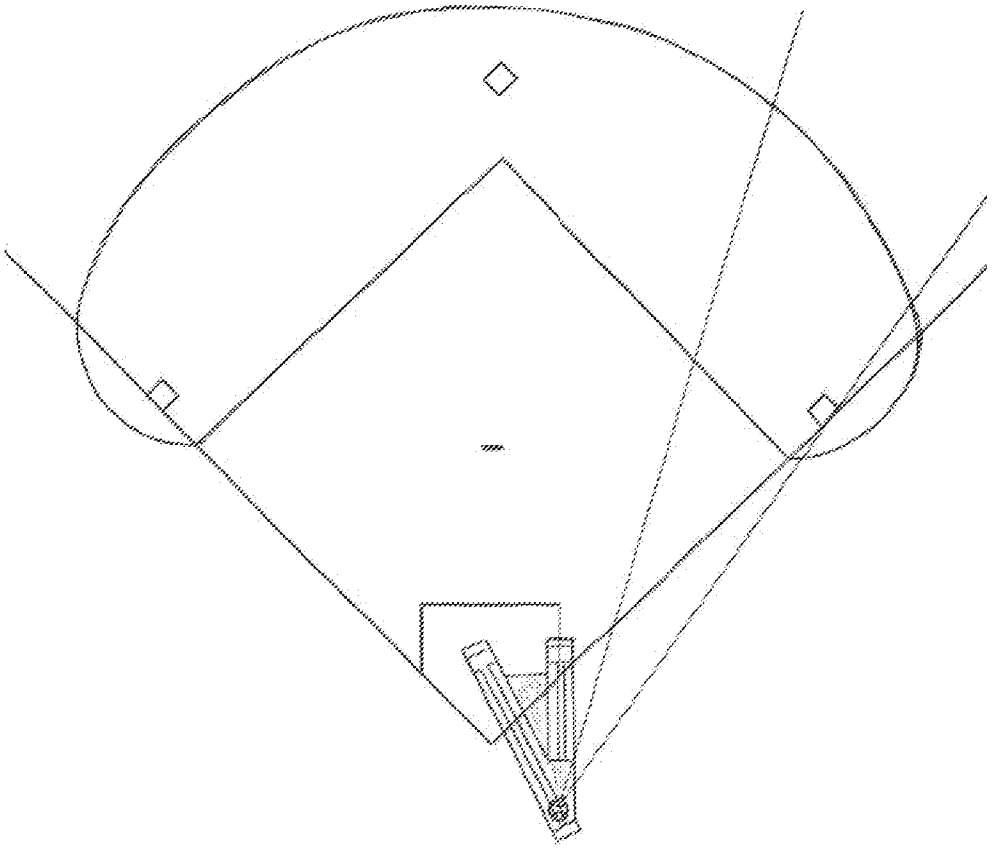
FIG. 11 is a drawing that shows how the present invention would be used to hit an outside pitch by a righthanded batter and the direction in which the ball would travel after being hit.
Figure 12:
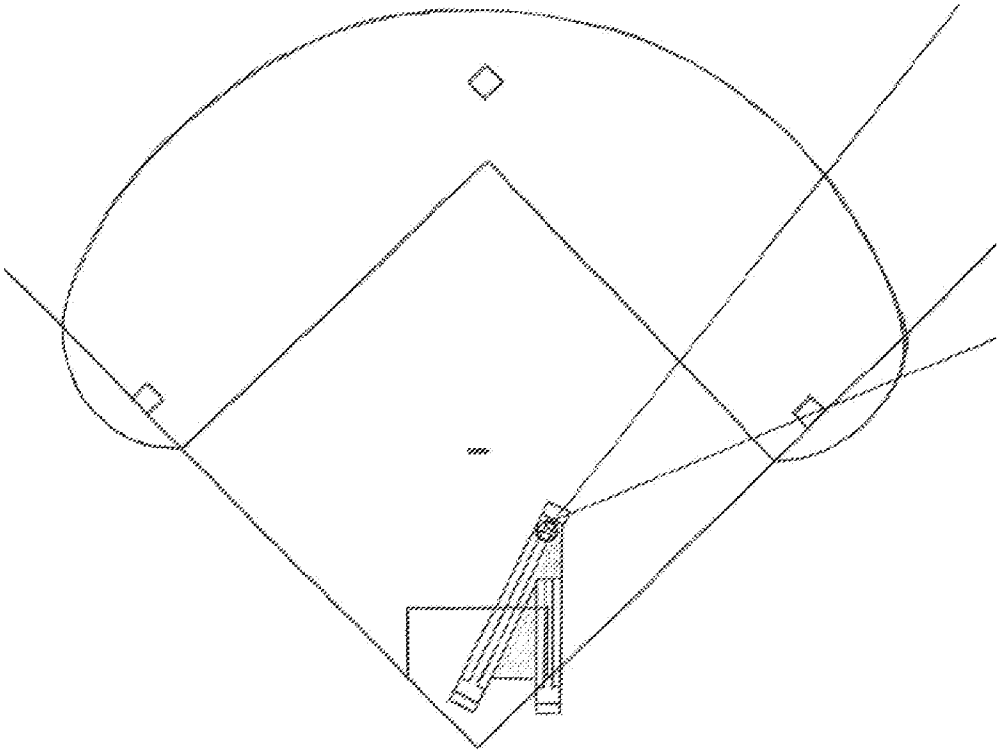
FIG. 12 is a drawing that shows how the present invention would be used to hit an inside pitch by a lefthanded batter and the direction in which the ball would travel after being hit.
Figure 13:
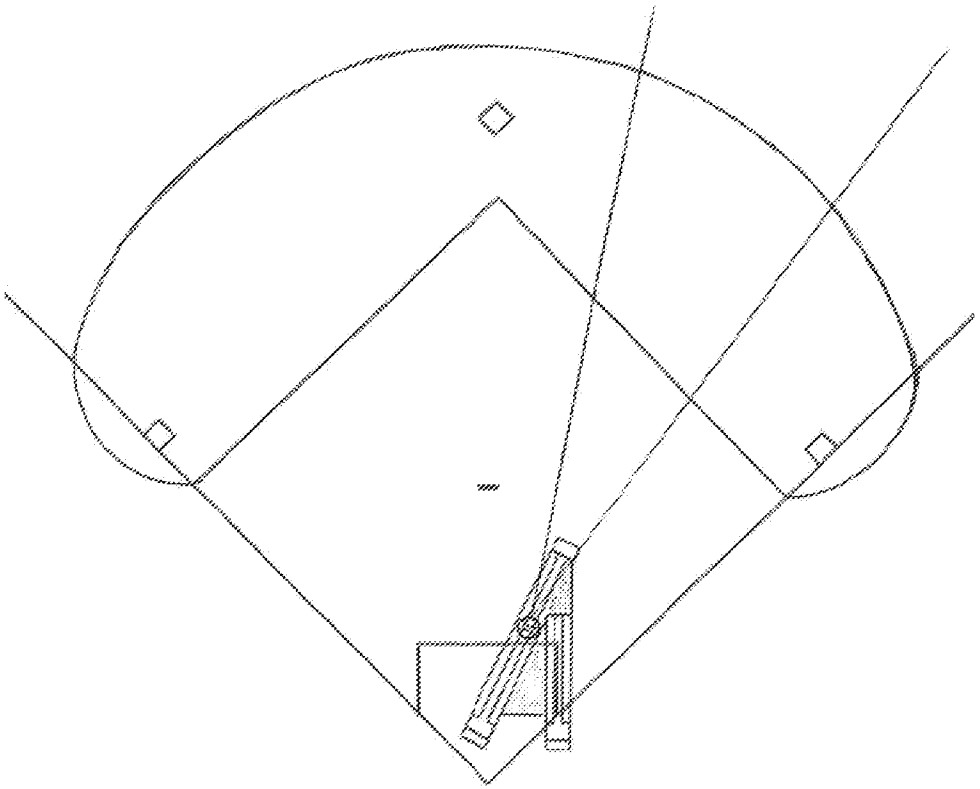
FIG. 13 is a drawing that shows how the present invention would be used to hit another inside pitch by a lefthanded batter and the direction in which the ball would travel after being hit.
Figure 14:
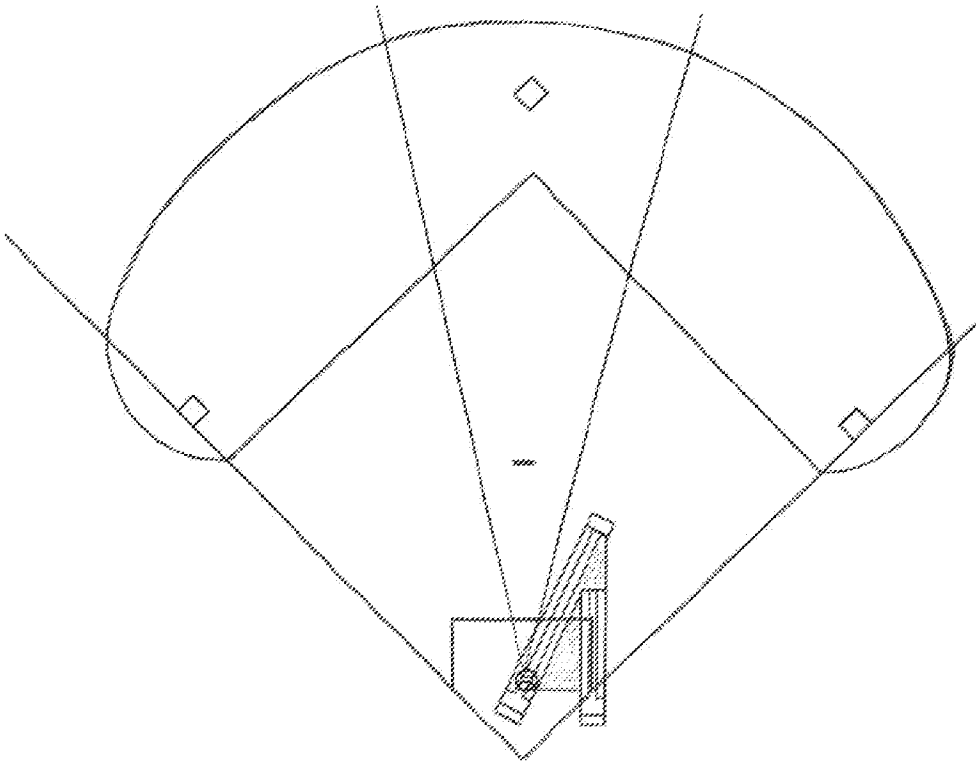
FIG. 14 is a drawing that shows how the present invention would be used to hit a middle pitch by a lefthanded batter and the direction in which the ball would travel after being hit.
Figure 15:
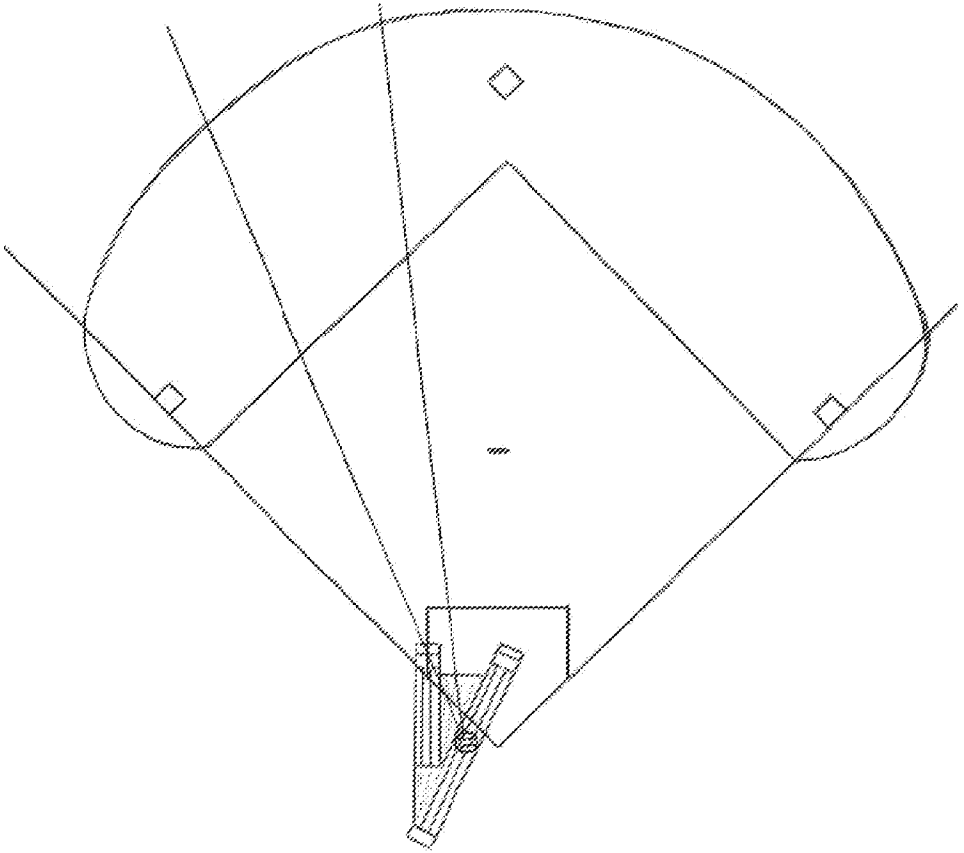
FIG. 15 is a drawing that shows how the present invention would be used to hit a middle to outside pitch by a lefthanded batter and the direction in which the ball would travel after being hit.
Figure 16:
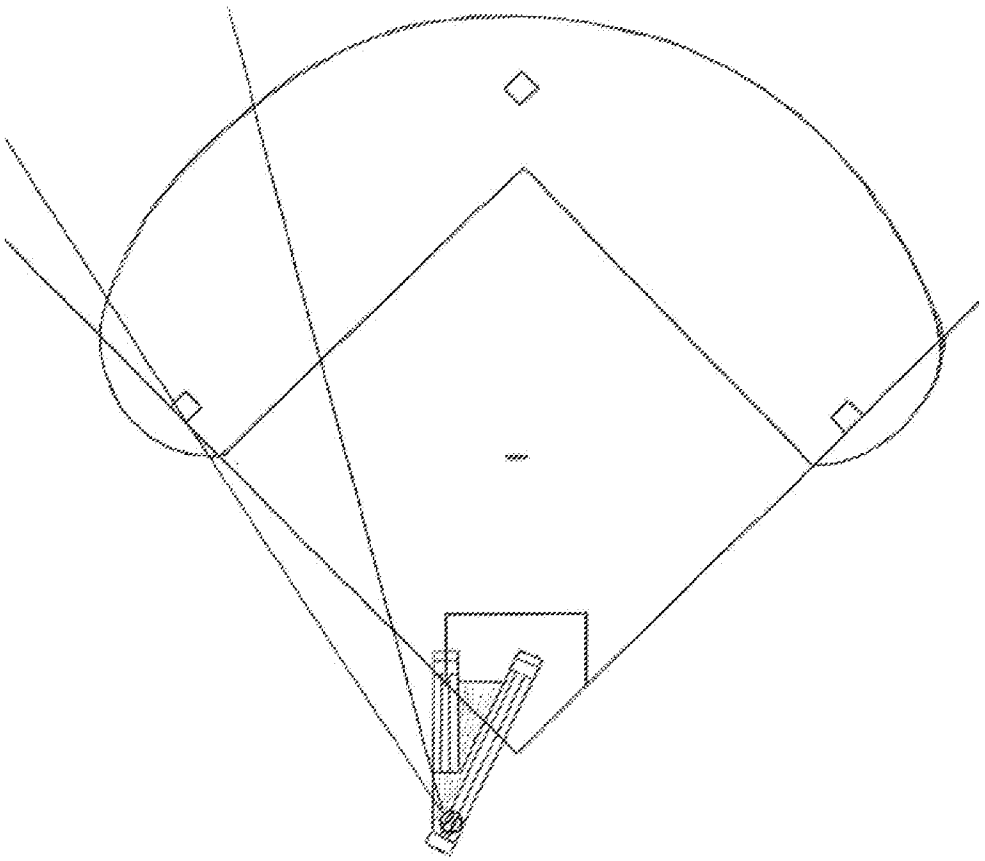
FIG. 16 is a drawing that shows how the present invention would be used to hit an outside pitch by a lefthanded batter and the direction in which the ball would travel after being hit.
Figure 17:
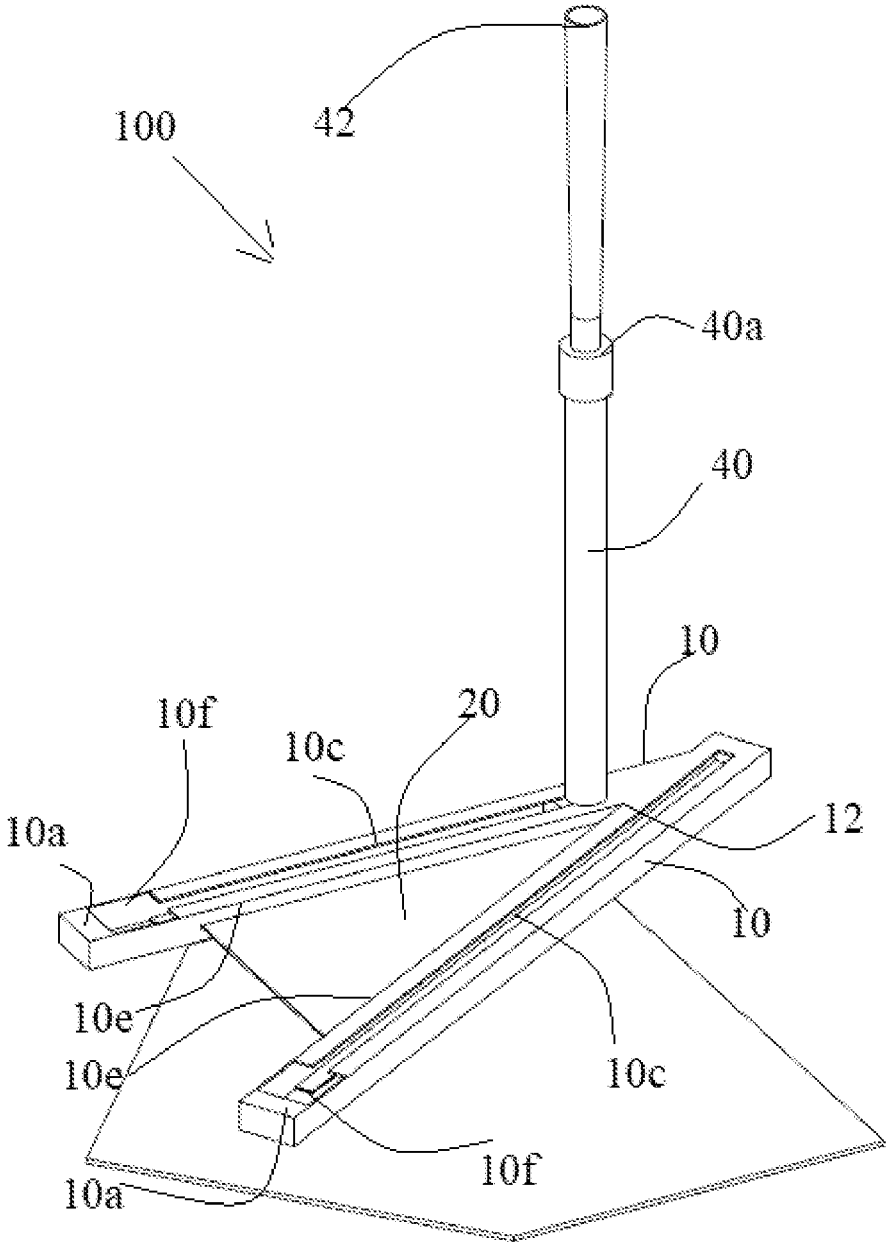
FIG. 17 is a perspective view of the present invention, the view shows how the invention would be placed for a righthanded batter.
Figure 18:
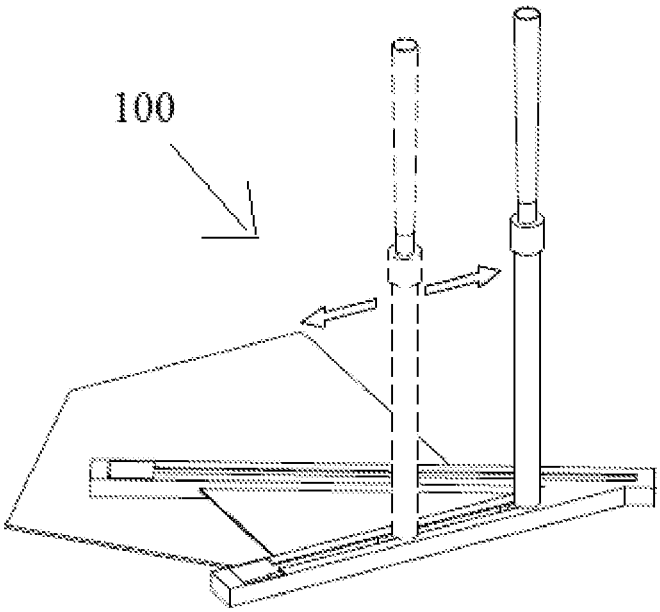
FIG. 18 is a perspective view of the present invention, the view shows how the invention would be placed for a lefthanded batter.
Figure 19:
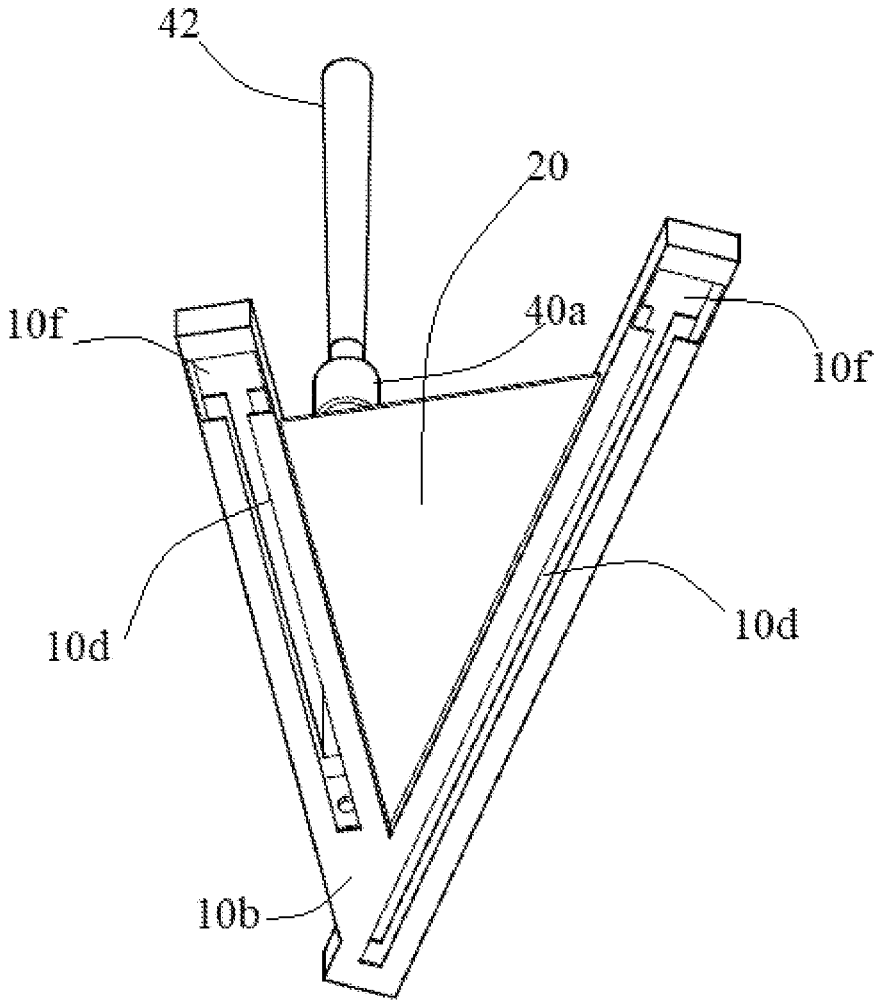
FIG. 19 is a perspective view of the present invention showing the lower part of the invention.
Figure 20:
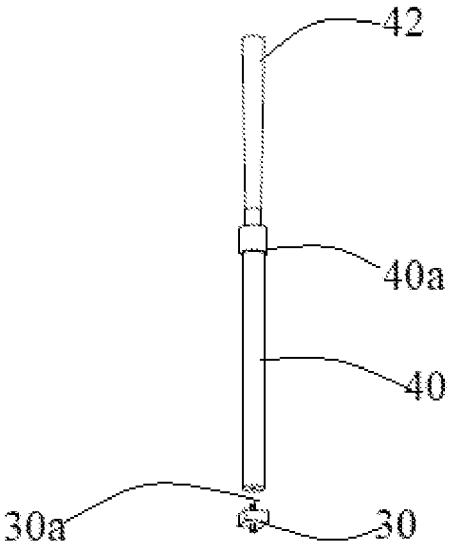
FIG. 20 is a perspective view of the block and post of the present invention.
Figure 21:
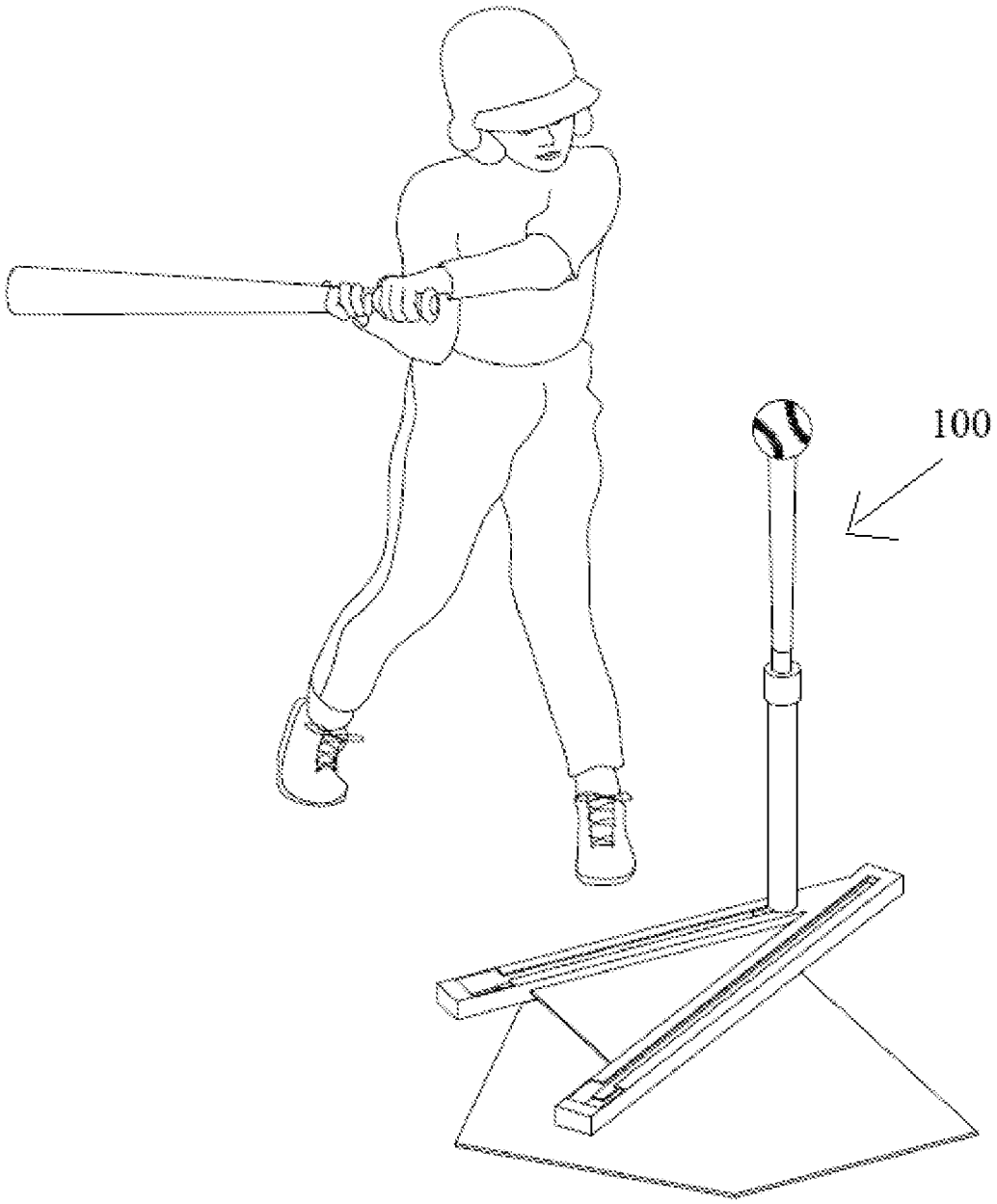
FIG. 21 is a perspective view that shows how a righthanded hitter would hit a ball on the present invention.

As seen in FIGS. 17-20, the present invention is a batting tee.

The batting tee 100 comprises of a pair of weighted legs 10 that extend from a point of origin 12, an angle of twenty-five degree is created between the two weighted legs 10 from the point of origin 12, the pair of weighted legs 10 are attached to each other, the pair of weighted legs 10 have an upper part 10*a* and a lower part 10*b*, each weighted leg is hollow and defines an upper linear channel 10*c* and a lower linear channel 10*d* that is configured to receive a block 30 that sustains a post 40. A triangular weighted sheet 20 attaches to an inside side section 10*e* of each of the pair of weighted legs 10, each weighted leg 10 of the pair of weighed legs defines a block insertion point 10*f* at a location that is at a furthest distance from the point of origin, the block insertion points 10*f* are defined on the upper part 10*a* and the power part 10*b* of each weighted leg. A block 30, the block 30 has an attachment point 30*a*, the block 30 inserts within either the upper liner channel 10*c* or the lower linear channel 10*d*, And, a post 40 that attached to the block 30 at the attachment point 30*a*. The post 40 defines a ball holder 42 on an end of the post 40*a* that does not attach to the block 30.

In a preferred embodiment, the attachment point 30*a* of the block 30 is a screw 30*a* and the post 40 screws on the screw 30*a*. In a preferred embodiment, the post is a telescopic post.

In preferred embodiments of the present invention, the pair of weighted legs and the triangular weighted sheet are made of metal.

In preferred embodiments of the present invention, the post 40 is a telescopic post.

An advantage of the present invention is that it provides a batting tee that is easy to manipulate.

Another advantage of the present invention is that it provides a batting tee that is easy to transport.

Yet another advantage of the present invention is that it provides a batting tee is used by righthanded and lefthanded hitters to maximize their hitting potential over balls that pass over home plate.

While the inventor's above description contains many specificities, these should not be construed as limitations on the scope, but rather as an exemplification of several preferred embodiments thereof. Many other variations are possible. Accordingly, the scope should be determined not by the embodiments illustrated, but by the specification, the drawings, and the appended claims and their legal equivalents.

What is claimed is:

1. A batting tee that can be used by righthanded hitter and lefthanded hitters to expand their batting zone, the batting tee comprises:

a pair of weighted legs that extend from a point of origin, an angle of twenty-five degree is created between the two weighted legs from the point of origin, the pair of weighted legs are attached to each other, the pair of weighted legs have an upper part and a lower part, each weighted leg is hollow and defines an upper linear channel and a lower linear channel that is configured to receive a block that sustains a post;

a triangular weighted sheet attached to an inner side of each of the pair of weighted legs, each weighted leg of the pair of weighed legs defines a block insertion point at a location that is at a furthest distance from the point of origin, the block insertion points are defined on the upper part and the lower part of each leg;

a block having an attachment point, the block inserts within either the upper liner channel or the lower linear channel; and a post attached to the block at the attachment point, wherein the post defines a ball holder.

2. The batting tee that can be used by righthanded hitters and lefthanded hitters to expand their batting zone of claim 1, wherein the pair of weighted legs and the triangular weighted sheet are made of metal.

3. The batting tee that can be used by righthanded hitters and lefthanded hitters to expand their batting zone of claim 2, wherein the attachment point of the block is a screw and the post is attached on the screw.

4. The batting tee that can be used by righthanded hitters and lefthanded hitters to expand their batting zone of claim 1, wherein the attachment point of the block is a screw and the post is attached on the screw.

5. The batting tee that can be used by righthanded hitters and lefthanded hitters to expand their batting zone of claim 1, wherein the post is a telescopic post.

* * * * *